US009235953B2

(12) United States Patent
Earley et al.

(10) Patent No.: US 9,235,953 B2
(45) Date of Patent: Jan. 12, 2016

(54) MOBILE APPLICATIONS AND WAGERING GAME MACHINES

(71) Applicant: WMS Gaming, Inc., Waukegan, IL (US)

(72) Inventors: Edward Q. Earley, Chicago, IL (US); Mark B. Gagner, West Chicago, IL (US); Damon E. Gura, Chicago, IL (US); Daniel P. Louie, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 152 days.

(21) Appl. No.: 13/804,034

(22) Filed: Mar. 14, 2013

(65) Prior Publication Data

US 2013/0337890 A1 Dec. 19, 2013

Related U.S. Application Data

(60) Provisional application No. 61/659,817, filed on Jun. 14, 2012.

(51) Int. Cl.
*G07F 17/32* (2006.01)

(52) U.S. Cl.
CPC ..... *G07F 17/3225* (2013.01); *G07F 17/3218* (2013.01); *G07F 17/3244* (2013.01); *G07F 17/3267* (2013.01)

(58) Field of Classification Search
CPC ..... G07F 17/3218; G07F 17/3225; G07F 17/3244; G07F 17/3267
USPC ..... 463/25, 29, 40–42
See application file for complete search history.

(56) References Cited

U.S. PATENT DOCUMENTS

| | | | | |
|---|---|---|---|---|
| 6,846,238 | B2 * | 1/2005 | Wells | 463/39 |
| 7,699,703 | B2 * | 4/2010 | Muir et al. | 463/29 |
| 8,671,019 | B1 * | 3/2014 | Barclay et al. | 705/14.41 |
| 2003/0060248 | A1 * | 3/2003 | Yamashita | 463/1 |
| 2003/0065738 | A1 * | 4/2003 | Yang et al. | 709/215 |
| 2006/0111168 | A1 * | 5/2006 | Nguyen et al. | 463/16 |
| 2006/0202422 | A1 * | 9/2006 | Bahar | 273/274 |
| 2006/0252530 | A1 | 11/2006 | Oberberger et al. | |
| 2007/0021198 | A1 * | 1/2007 | Muir et al. | 463/29 |
| 2009/0170596 | A1 | 7/2009 | Gagner et al. | |
| 2010/0211431 | A1 | 8/2010 | Lutnick et al. | |
| 2010/0317423 | A1 | 12/2010 | Osborne | |
| 2012/0004026 | A1 * | 1/2012 | Vann | 463/25 |
| 2012/0094769 | A1 | 4/2012 | Nguyen et al. | |
| 2012/0122558 | A1 | 5/2012 | Lyons et al. | |
| 2012/0124624 | A1 | 5/2012 | Lau et al. | |
| 2013/0337878 | A1 | 12/2013 | Shepperd et al. | |

FOREIGN PATENT DOCUMENTS

| | | | |
|---|---|---|---|
| JP | 2007-236537 | A | 9/2007 |
| JP | 2008-079836 | A | 4/2008 |

* cited by examiner

*Primary Examiner* — Paul A D'Agostino
*Assistant Examiner* — David Duffy
(74) *Attorney, Agent, or Firm* — DeLizio Law, PLLC

(57) ABSTRACT

In some embodiments, a method includes presenting a wagering game at a wagering game machine. The method includes establishing a wireless communication between the wagering game machine and a mobile device. The method also includes, in response to a wagering game player satisfying a wagering game criteria when playing the wagering game, enabling access to content on the mobile device, wherein the content is based on a context resulting from the wagering game player playing the wagering game.

28 Claims, 11 Drawing Sheets

MOBILE APPLICATIONS AND WAGERING GAME MACHINES

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2013, WMS Gaming, Inc.

FIELD

Embodiments of the inventive subject matter relate generally to wagering game systems, and more particularly to mobile applications and wagering game machines.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

BRIEF DESCRIPTION OF THE FIGURES

Embodiments of the invention are illustrated in the Figures of the accompanying drawings in which.

DESCRIPTION OF THE EMBODIMENTS

Figure 1:
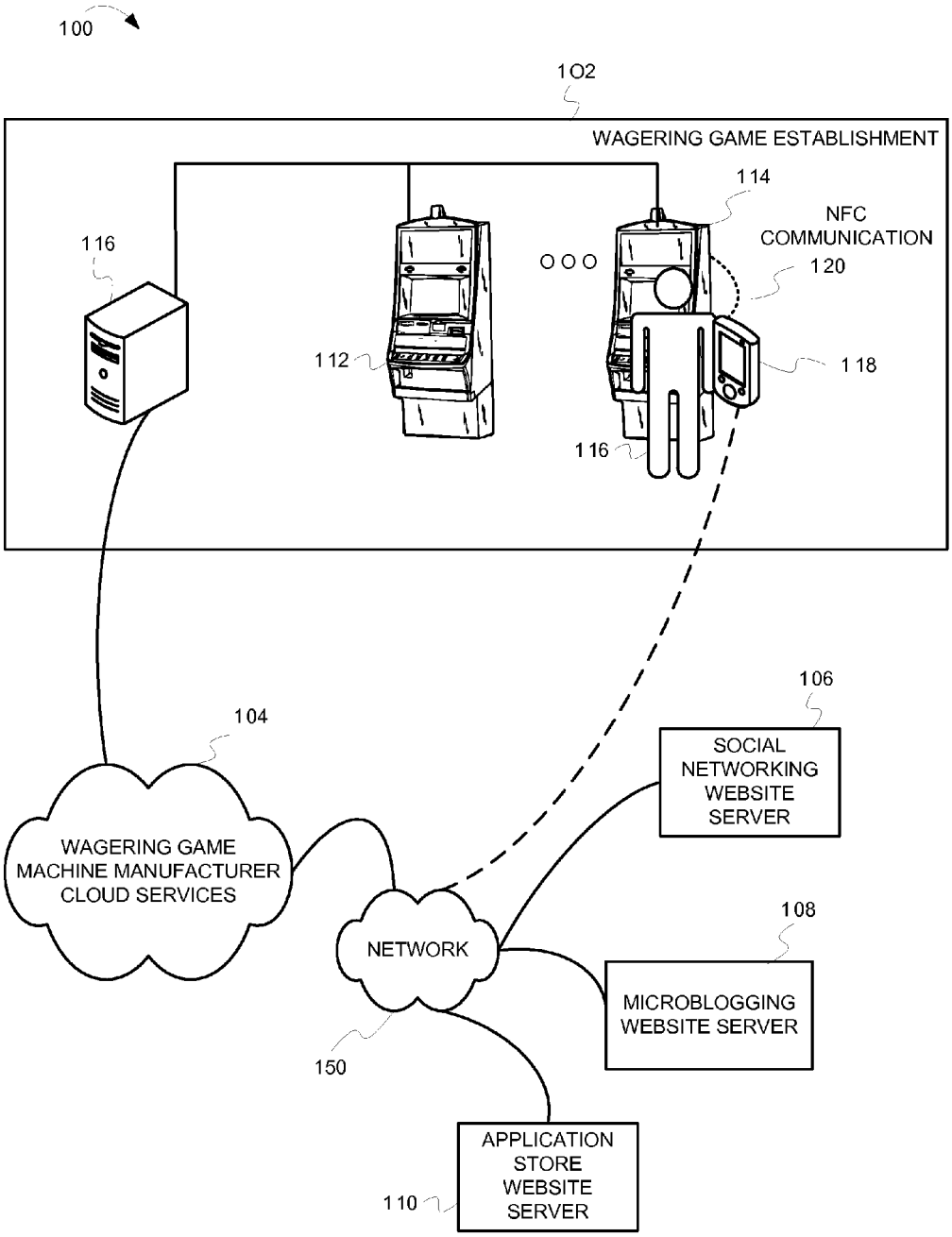
FIG. 1 depicts a system for enabling wireless communication between mobile applications executing on mobile devices of wagering game players and wagering game machines on which the players are executing, according to some example embodiments.

This description of the embodiments is divided into seven sections. The first section provides an introduction to some example embodiments, while the second section describes an example system environment. The second section is divided into four subsections. A first subsection describes example communications for a mobile application download. A second subsection describes example mobile applications. A third subsection describes example communications for a play-while-away mobile application. A fourth subsection describes example communications for a scavenger hunt mobile application. The third section describes an example mobile device. The fourth section describes example operations performed by some example embodiments. The fifth section describes a wagering game machine architecture, and the sixth section describes a wagering game network. The seventh section describes an example wagering game machine and the seventh section presents some general comments.

INTRODUCTION

This section provides an introduction to some example embodiments. Some example embodiments include short range wireless communications between a mobile device executing a mobile application and a wagering game machine. For example, the wireless communications is between a mobile device (e.g., a smart phone) of a wagering game player and the wagering game machine that the wagering game player is playing. In some example embodiments, this short range wireless communication is based on different types of communication standards (e.g., Near Field Communications (NFC), Bluetooth, etc.). In some example embodiments, this short range wireless communication comprises infrared transmission. The range of communication can vary but is generally considered short (e.g., less than 10 centimeters, less than 20 centimeters, less than 5 centimeter, less than three feet, less than 12 inches, less than six inches, etc.). In some example embodiments, the wireless communication can be either unidirectional or bi-directional.

The wireless communications can be communications regarding content that is specific to the game being played at the wagering game machine. In some example embodiments, content is provided to the mobile device based on context of what is being played at the wagering game machine, context of where the player is within the wagering game (e.g., progress in the wagering game), the game play history by the player for the wagering game, etc. For example, a mobile application is downloaded to the mobile device of the wagering game player based on the theme of the wagering game machine. The mobile application can be downloaded from an application store hosted on a server and transmitted over a network (e.g., the Internet). The mobile application can be a version of the game being played at the wagering game machine. To illustrate, if the game at the wagering game machine is a slot game having a theme A, the wagering game machine can provide this identification to the mobile device. The mobile device can then download a version of the slot game having a theme A for play on the mobile device. As further described below, the mobile device can download the content from a network server based on a separate wireless communication (independent of the wagering game machine). Alternatively or in addition, the mobile device can download the content from a network server based on the wireless communication with the wagering game machine. Alternatively or in addition, the mobile device can download the content from local storage within the wagering game machine based on the wireless communication with the wagering game machine.

In some example embodiments, the version of the wagering game playable on the mobile device is free based on this communication between the wagering game machine and the player's mobile device after the player has wagered a minimum amount. Otherwise, this version of the wagering game playable on the mobile device is generally available for download for a given monetary cost over the Internet or is not available any other way. Additionally, this free version of the wagering game may only be available at a specific wagering game establishment or group of wagering game establishments owned by a same entity. Also, this promotion for giving away the free version can be on certain days or certain times of day. For example, a wagering game establishment may want to incentivize persons during days or times when foot traffic is generally small. In some example embodiments, the version of the wagering game playable on the mobile device is only available after completion of some criteria. For example, the criteria can include the player reaching a bonus round for the wagering game at the wagering game machine; the player logging into a player account associated with the wagering game establishment and/or the wagering game manufacturer, exceeding a certain monetary amount inputted into the wagering game machine (i.e., coin-in), etc.

In another example, a free limited version of a wagering game can be generally available for download to the mobile device. However, the full version of the wagering game playable on the mobile device may only be available after the player has obtained a certain achievement, level, etc. of the wagering game at the wagering game machine. Accordingly, the progression in the play at the wagering game machine determines the amount of content (e.g., levels) that is available for download and play of the version for the mobile application. For example, as the wagering game player progresses further in the play at the wagering game machine, more content is available for the version of the mobile application.

In some example embodiments, unique content is unlocked within the mobile application because of the wireless communications between the mobile device and the wagering game machine. For example, the mobile application can be available without this communication with the wagering game machine. However, because of this communication with the wagering game machine, the mobile application that is downloaded includes new levels, new content, etc. that would be unavailable otherwise. In some example embodiments, the unique content is unlocked within the wagering game machine because of the wireless communications between the mobile device and the wagering game machine.

The mobile application can be an application that enables communications among the different wagering game players that are currently playing the specific type of the wagering game machine. For example, a chat session can be established to enable exchanges of tips, payouts, etc. for the wagering game.

Some example embodiments are incorporated into the play-while-away wagering game configurations. In particular, the wireless communication with the mobile application on the mobile device can be used for updates regarding play-while-away activity at a different wagering game machine.

Some example embodiments are applicable to a scavenger hunt-based activity across a number of wagering games. In such an example, a wagering game player is required to perform different types of wagering at different wagering game machines to complete the scavenger hunt. The wagering game player's mobile device can include a mobile application to wirelessly communicate with these different wagering game machines. In particular, after an assigned wagering for a particular wagering game machine is complete, the mobile application on the mobile device receives a wireless communication from this wagering game machine of this completed task. Accordingly, the particular mobile application tracks the completion of the different tasks for the scavenger hunt by the wagering game player.

In some example embodiments, content can be uploaded from the mobile device to the wagering game machine that affects the wagering game play on the wagering game machine. For example, the wagering game player can upload visual or audio content from their mobile device that is incorporated into the wagering game play at the wagering game machine. Such content can include changes to the look of a character representative of the wagering game player in the game; changes to the background; changes to the card backs in a poker game; and replacement of a face of a character in the wagering game with a face from an image stored on the mobile device.

System Environment

This section describes various system environments of some example embodiments. This section includes various configurations and applications for communications between mobile applications executing on mobile devices of wagering game players and wagering game machines on which the players are executing. FIG. 1 depicts a system for enabling wireless communication between mobile applications executing on mobile devices of wagering game players and wagering game machines on which the players are executing, according to some example embodiments. This wireless communication can be based on any of a number of different standards (e.g., NFC, Bluetooth, etc.). In some example embodiments, the mobile applications are downloaded to the mobile device in response to establishment of communication between the mobile device and the wagering game machine. The mobile applications can be downloaded from or through the wagering game machine. Alternatively or in addition, the mobile applications can be downloaded from some remote web services or server over a network (e.g., the Internet). As further described below, the mobile application can be various content related to the wagering game machine. For example, the mobile application can be a mobile version of the wagering game being played on the wagering game machine.

FIG. 1 depicts a system 100 that includes a number of wagering game machines (shown as a wagering game machine 112 and a wagering game machine 114) and a wagering game server 116. The wagering game machine 112-114 and the wagering game server 116 are part of a wagering game establishment 102 and communicatively coupled together. The system 100 also includes wagering game machine manufacturer cloud services 104 and a number of servers (servers 106-108) that can be external to the wagering game establishment and part of a network for providing web services (e.g., the Internet). As shown, the wagering game machine manufacturer cloud services 104 and the servers 106-108 are coupled together through a network 150. The server 106 is a server for hosting a social networking website. The server 108 is a server for hosting a microblogging website. The server 110 is a server for hosting an application store website. The mobile applications that are downloaded to the mobile devices can be downloaded from or through the wagering game machine manufacturer cloud services 104 and the servers 106-108.

To illustrate, a wagering game player 116 is playing a wagering game at the wagering game machine 114. The wagering game player 116 has a mobile device 118. Examples of the mobile device 118 include a smart phone, tablet computer, Personal Digital Assistant (PDA), etc. As shown, the mobile device 118 can access the wagering game machine manufacturer cloud services 104 and the servers 106-108 through a wireless communication using the network 150. The mobile device 118 can be communicatively coupled to the network 150 using radio communications (e.g., Global System for Mobile Communications (GSM), Code Division Multiples Access (CDMA), etc.).

As shown, the mobile device 118 has an NFC communication 120 established with the wagering game machine 114. The NFC communication 120 can be established once the mobile device 118 is in communication range of the wagering game machine 114. In some example embodiments, this short range wireless communication comprises Bluetooth or infrared transmission. The range of communication can vary but is generally considered short (e.g., less than 10 centimeters, less than 20 centimeters, less than 5 centimeter, less than three feet, less than 12 inches, less than six inches, etc.). In some example embodiments, the wireless communication can be either unidirectional or bi-directional. The wagering game machine 114 can notify the mobile device 118 that a mobile application that is related to the wagering game machine 114 is available for download. In some example embodiments, the mobile application is not available for download until a wagering game criteria are met. The wagering game criteria can vary. Examples include a wagering game player logging into a player account associated with the wagering game establishment 102 and/or the wagering game manufacturer, exceeding a certain monetary amount inputted into the wagering game machine 114 (i.e., coin-in), exceeding a certain monetary amount wagered at the wagering game machine 114, etc.

In some example embodiments, using the NFC communication 120, the wagering game machine notifies the mobile device 118 that a mobile application is available for download. The wagering game player is then given the option to down the mobile application to their mobile device 118 (assuming the mobile application is not already downloaded therein). Also, the mobile application can be downloaded from or through the wagering game machine 114 using the NFC communication 120. Alternatively or in addition, the mobile application can be downloaded independent of the wagering game machine 114 and through the wireless communication with the network 150. The mobile application can be stored in the wagering game machine manufacturer cloud services 104. Accordingly, the mobile application can be accessed through the wagering game machine 114 and the wagering game server 116. Alternatively or in addition, the mobile application can be accessed from the wagering game machine manufacturer cloud services 104 using any one of the servers 106-110. For example, the mobile device 118 can download the mobile application through an account on the social networking website using the social networking website server 106. In some example embodiments, the mobile application can be stored and accessed from the application store website server 110. In some example embodiments, the wagering game player 116 is given the option of the location from which to download and the route for the download. In some example embodiments, content is provided to the mobile device based on context of what is being played at the wagering game machine, context of where the player is within the wagering game (e.g., progress in the wagering game), the game play history by the player for the wagering game, etc.

Example Communications for Mobile Application Download

Figure 2:
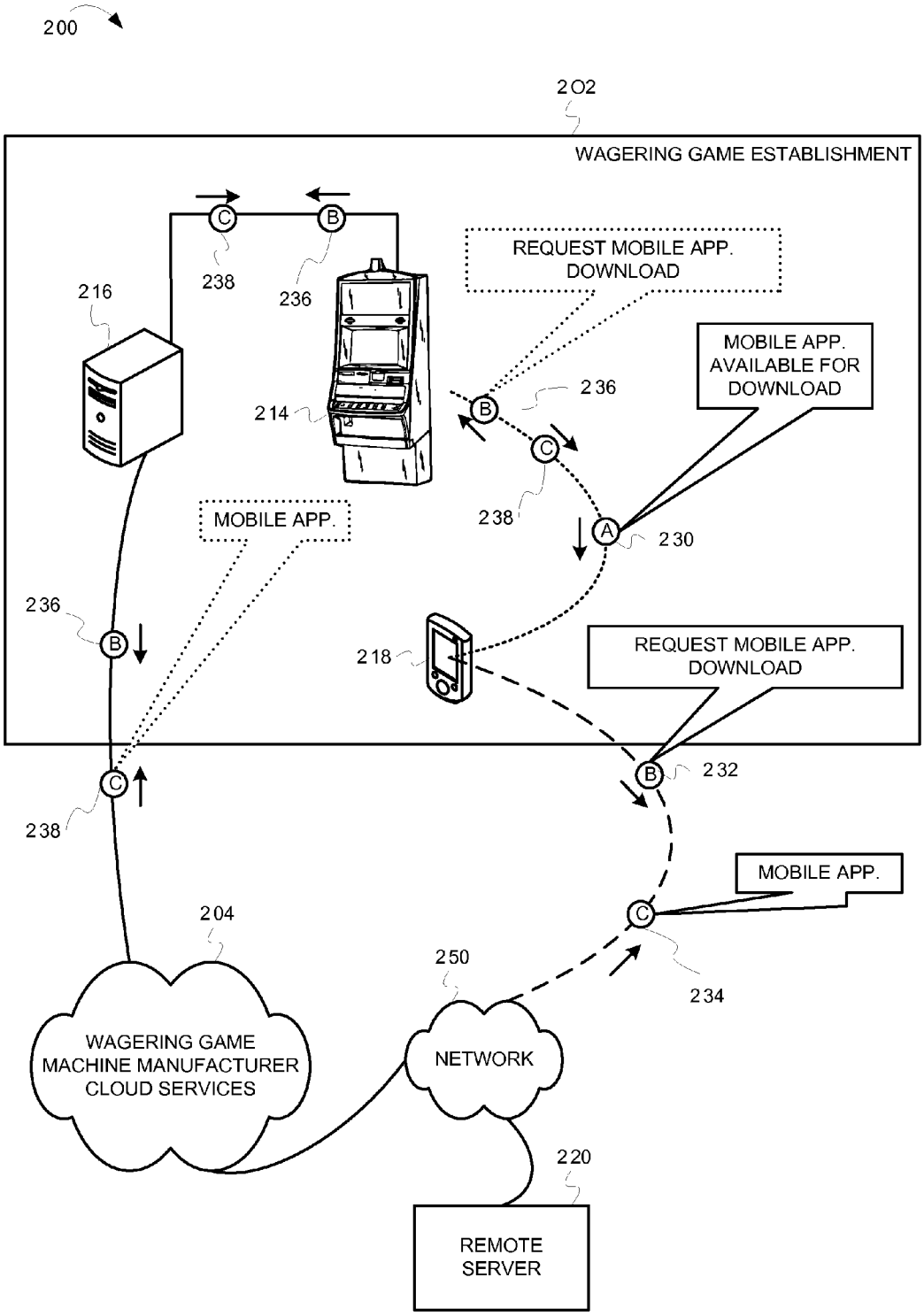
FIG. 2 depicts a system that includes communications for enabling download of a mobile application to a mobile device, according to some example embodiments.

A more detailed description of the communications for downloading the mobile application is now described. In particular, FIG. 2 depicts a system that includes communications for enabling download of a mobile application to a mobile device, according to some example embodiments. In particular, FIG. 2 depicts a system 200 that illustrates the communications between a wagering game machine and a mobile device to download a mobile application on the mobile device.

A wagering game machine 214 and a wagering game server 216 are part of a wagering game establishment 202 and communicatively coupled together. The system 100 also includes wagering game machine manufacturer cloud services 104 and a remote server 220 (that is representative of one of the servers 106-108 of FIG. 1) that can be external to the wagering game establishment and part of a network for providing web services (e.g., the Internet). As shown, the wagering game machine manufacturer cloud services 104 and the remote server 220 are coupled together through a network 250. As shown, the mobile applications that are downloaded to the mobile devices can be downloaded from or through the wagering game machine manufacturer cloud services 104 and the servers 106-108.

In this example, the wagering game player (not shown) associated with a mobile device 218 is playing a wagering game at the wagering game machine 214. In response to being in wireless communication range of the mobile device 218, the wagering game machine 214 can initiate communication with the mobile device 218. In this example, using the wireless communication, the wagering game machine 214 notifies the mobile device 218 that a mobile application that is related to the wagering game machine 218 is available for download (communication 230). In some example embodiments, this notification is not transmitted until a wagering game criteria are met. As described above, examples of a wagering game criteria can be a login by the wagering game player into their player account associated with the wagering game establishment 202 and/or the wagering game manufacturer, exceeding a certain monetary amount inputted into the wagering game machine 214 (i.e., coin-in), exceeding a certain monetary amount wagered at the wagering game machine 214, etc.

The wagering game player is then given the option to download the mobile application to their mobile device 218 (assuming the mobile application is not already downloaded therein). Also, the mobile application can be downloaded from or through the wagering game machine 214 using the wireless communication. Alternatively or in addition, the mobile application can be downloaded independent of the wagering game machine 214 and through the wireless communication with the network 250. The mobile application can be stored in the wagering game machine manufacturer cloud services 204. Accordingly, the mobile application can be accessed through the wagering game machine 214 and the wagering game server 216. Alternatively or in addition, the mobile application can be accessed from the wagering game machine manufacturer cloud services 204 using the remote servers 220. For example, the mobile device 218 can download the mobile application through an application store website. In some example embodiments, the wagering game player is given the option of the location from which to download and the route for the download.

FIG. 2 depicts the two different routes for downloading of the mobile application to the mobile device 218. For the first route, the mobile device 218 can download the mobile application independent of a route that includes the wagering game machine 214. The mobile device 218 requests the mobile application from the wagering game machine manufacturer cloud services 204 or the remote server 220 (communication 232). In some example embodiments, the mobile application is stored in the wagering game machine manufacturer cloud services 204. Accordingly, a request for the mobile application to the remote server 220 can translate to a download from the wagering game machine manufacturer cloud services 204. In response to the request, the mobile application is downloaded to the mobile device 218 (communication 234).

For the second route, the mobile device 218 can download the mobile application through the wagering game machine 214 using the wireless communication established with the wagering game machine 214 (communication 236). The wagering game machine 214 transmits the request to the wagering game server 216. The wagering game server 216 then retrieves the mobile application from the wagering game machine manufacturer cloud services 204. In response, the wagering game machine manufacturer cloud services 204 transmit the mobile application back to the wagering game server 216 (communication 238). The wagering game server 216 then transmits the mobile application to the wagering game machine 214. The wagering game machine 214 then transmits the mobile application to the mobile device 218 using the wireless communication. In some example embodiments, the mobile application can be stored locally in the wagering game machine 214. Therefore, the wagering game machine 214 can then download the mobile application to the mobile device 218 without the backend communications.

Example Mobile Applications

The mobile application can relate to different types of content related to the wagering game machine 214. For example, the mobile application can be a version of the game being played at the wagering game machine 214. In some example embodiments, the version of the wagering game playable on the mobile device 218 is free based on this communication between the wagering game machine 214 and the player's mobile device 218 after the player has wagered a minimum amount. Otherwise, this version of the wagering game playable on the mobile device 218 is generally available for download for a given monetary cost over the Internet or is not available any other way. Additionally, this free version of the wagering game may only be available at a specific wagering game establishment or group of wagering game establishments owned by a same entity. Also, this promotion for giving away the free version can be on certain days or certain times of day. For example, the wagering game establishment 202 may want to incentivize persons during days or times when foot traffic is generally small. In some example embodiments, content is provided to the mobile device based on context of what is being played at the wagering game machine, context of where the player is within the wagering game (e.g., progress in the wagering game), the game play history by the player for the wagering game, etc.

In another example, a free limited version of a wagering game can be generally available for download to the mobile device 218. However, the full version of the wagering game playable on the mobile device 218 may only be available after this communication between the wagering game machine 214 and the player's mobile device 218 and after the player has obtained a certain achievement, level, etc. of the wagering game at the wagering game machine 214. Accordingly, the progression in the play at the wagering game machine 214 determines the amount of content (e.g., levels) that is available for download and play of the version for the mobile application. For example, as the wagering game player progresses further in the play at the wagering game machine 214, more content is available for the version of the mobile application on the mobile device 218.

Some example embodiments are incorporated into the wagering game machine 214 wherein a wagering game player advances to higher levels over time based on game play. For example, for an adventure game (e.g., Lord of the Rings™), a wagering game player accumulates miles based on game play to advance to higher levels. The wagering game player can also accumulate miles online by playing casual (nonwagering) games related to the adventure game. For example, players can have player accounts for playing these casual games from the wagering game machine manufacturer cloud services 204. This same player account can be accessible through the wagering game machine 214. The wagering game player can use their player account for tracking these miles that are accumulated through wagering game play and online casual games.

In some example embodiments, the mobile application playable on the mobile device 218 offers these same casual games for accumulation of miles. If the mobile application is downloaded to the mobile device 218 as part of or in response to the communication with the wagering game machine 214 having this adventure game, the player can receive more miles (e.g., double miles) for a same casual game using this mobile application in comparison to online play. In some example embodiments, the mobile application downloaded as part of or in response to the communication with the wagering game machine can include promotional material or content for the wagering game establishment. The wagering game establishment is therefore willing to award more miles for casual game play using the mobile application because of the promotional content that is included therein. In some example embodiments, if the mobile application is downloaded to the mobile device 218 as part of or in response to the communication with the wagering game machine 214 having this adventure game, the player unlocks content (e.g., new levels, bonuses, etc.), given awards, given promotional credits, etc.

In some example embodiments, unique content is unlocked within the mobile application because of the wireless communications between the mobile device 218 and the wagering game machine 214. For example, the mobile application can be available without this communication with the wagering game machine 214. However, because of this communication with the wagering game machine 214, the mobile application that is downloaded includes new levels, new content, etc. that would be unavailable otherwise.

The mobile application can be an application that provides a tutorial, a history of big wins, etc. for the wagering game machine 214. The mobile application can be an application to enable texting to your friends, contacts, etc. that are side betting on your wagering game activity at the wagering game machine 214.

The mobile application can be an application that allows for downloading of content from the wagering game machine 214. For example, the downloadable content can also include images, video, etc. of a replay of a win at the wagering game machine 214 that is downloaded from the wagering game machine 214 to the mobile device 218 using this wireless communication. Additionally, the mobile application can provide for the transmission of these images, video, etc. of the replay of the win to friends, contacts, etc. of the wagering game player, or posted on the wagering game player's account at a social networking website or microblogging website, etc. at the remote server 220.

The mobile application can be an application that enables communications among the different wagering game players that are currently playing the specific type of the wagering game machine 214. For example, a chat session can be established to enable exchanges of tips, payouts, etc. for the wagering game.

The mobile application can be an application that enables the player to create an account or access their current player account for a web services account for a specific wagering game establishment or the specific manufacturer of the wagering game machine. Additionally, once logged into their player account, the mobile application enables the wagering game player to enter a tournament for players playing across different wagering game machines of the same type in a same wagering game establishment or across multiple wagering game establishments. In some example embodiments, the players can enter such a tournament after they have reached a certain level of game play at the wagering game machine. Accordingly, after this level is reached, the wagering game machine 214 wirelessly communicates with the mobile device 218 that this level has been obtained. In response, the mobile application then presents an option for the wagering game player to enter the tournament for the wagering game at the wagering game machine 214.

In some example embodiments, a mobile application on the mobile device 218 can provide recordkeeping about wagering game play at the wagering game machine 214. In particular, the wagering game machine 214 can use the wireless communication with the mobile device 218 to provide data about wins, losses, time and date when this activity has occurred, the serial number of the wagering game machine 214, fault information to a technician for diagnostic purposes, event meters showing game statistics, location of the wagering game establishment, etc. Such data can be particularly useful for reporting of taxes at a subsequent date.

In some example embodiments, the mobile application can be an application that provides a notification when a different wagering game machine is available. In particular, the wagering game player can use the mobile application to wirelessly communicate that a notification be provided by the current wagering game machine when the different wagering game machine is available. The current and different wagering game machines are communicatively coupled together through a network. Network communication from the different wagering game machine to the current wagering game machine provides this notification. The current wagering game machine (the wagering game machine 214) can then provide this notification to the wagering game player using the mobile application through the wireless communication with the mobile device 218. In some example embodiments, the wagering game player can use the mobile application to reserve the different wagering game machine for a short time period (e.g. two minutes).

In some example embodiments, this wireless communication can affect game play at the wagering game machine 214. For example, because of the mobile device 218 (with the mobile application) being present and wirelessly communicating with the wagering game machine 214, additional content is unlocked or available on the wagering game machine 214 that would not be otherwise. For example, certain paths within an adventure game are now shown on the wagering game machine 214 because the mobile application on the mobile device 218 is wirelessly communicating with the wagering game machine 214.

In some example embodiments, content can be uploaded from the mobile device 218 to the wagering game machine 214 that affects the wagering game play on the wagering game machine 214. For example, the wagering game player can upload visual or audio content from their mobile device 218 that is incorporated into the wagering game play at the wagering game machine 214. Such content can include changes to the look of a character representative of the wagering game player in the game; changes to the background; changes to the card backs in a poker game; and replacement a face of a character on the wagering game with a face from an image stored on the mobile device 218.

In some example embodiments, the mobile application on the mobile device 218 is used for shared bonuses among wagering game players at different wagering game machines. For example, a wagering game player can share a bonus from their wagering game with other wagering game players (e.g., friends) at other wagering game machines. In one such example, the mobile applications are used for notification (using wireless communications from the wagering game machines) and acceptance of the shared bonus. Therefore, in contrast to a pop-up screen on the wagering game machine, notification occurs via the mobile application. In some example embodiments, wagering game players can only be a part of shared bonus if the mobile application is on their mobile device and is communicating with the wagering game machine. This embodiment incentivizes the wagering game players to download and use the mobile applications that can include promotional content, material, etc.

Example Play-while-Away Mobile Application

Some example embodiments are incorporated into the play-while-away wagering game configurations. In particular, the play-while-away wagering games allow a wagering game player to initiate game play and then continue to enable the game play after the wagering game player leaves a wagering game machine where the game play was initiated. One such example includes a wagering game having a fishing theme. A community event displayed on a community display for a bank of wagering game machines includes a fish tank. At some point after the wagering game player has played the base game on one of the wagering game machines, a fish associated with the wagering game player is dropped into the fish tank in the community display. Alternatively or in addition, the wagering game player can purchase a fish that is dropped into the fish tank. At some later time, the fish is removed from the fish tank (based on a random determination). While in the community event in the fish tank, the wagering game player can win prizes based on the fish (not requiring any active participation by the wagering game player). Accordingly, the wagering game player can walk away from the wagering game machine but continue to win the prizes based on the fish in the community event. In some example embodiments, after this wagering game player's mobile device establishes wireless communication with a same or different wagering game machine, notification of the prizes won at the play-while-away wagering game can be provided to the wagering game player. This notification can also be through a mobile application that is downloaded to the mobile device (as part of the wireless communication).

Figure 3:
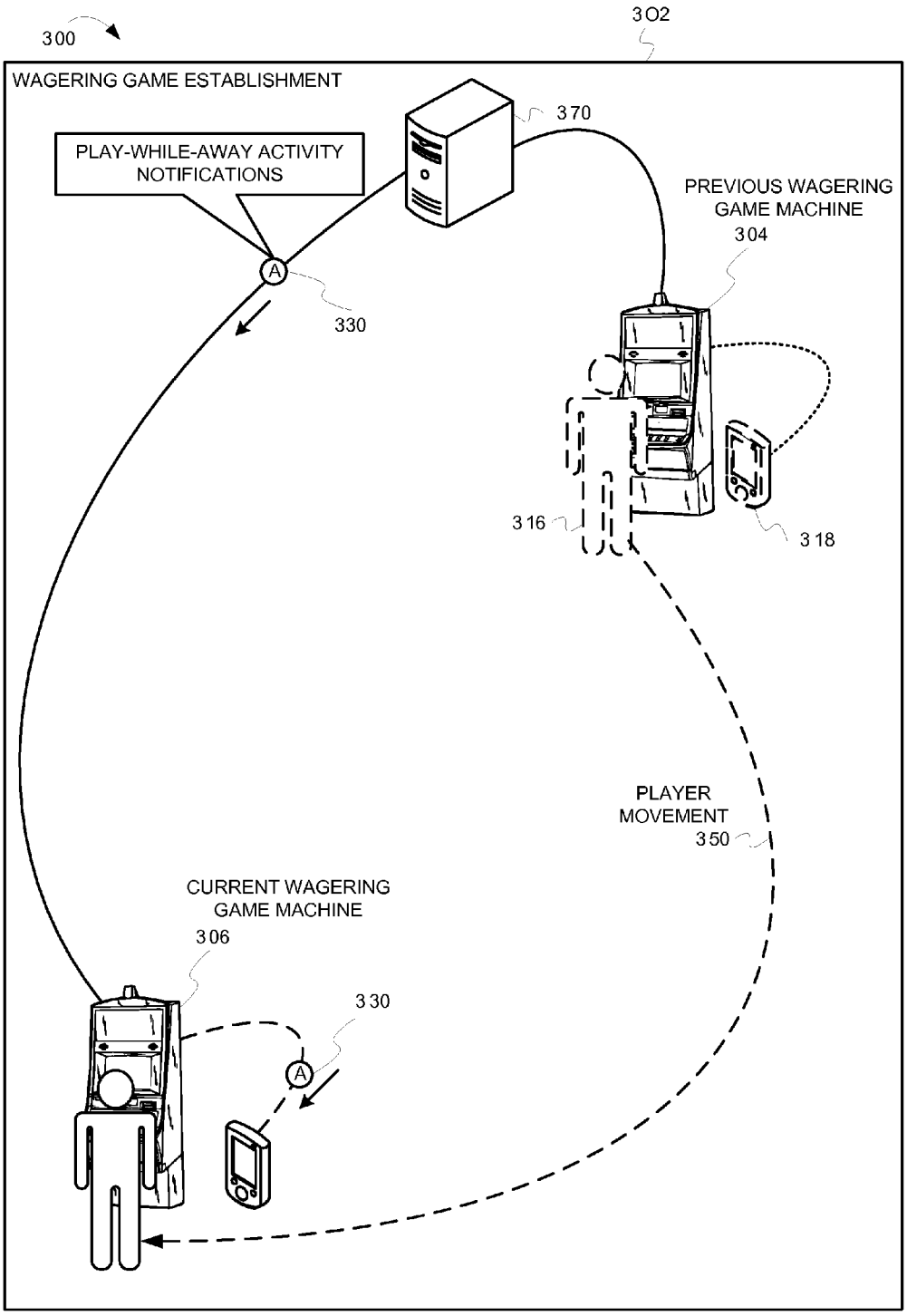
FIG. 3 depicts a system that includes communications for play-while-away activity notifications using a mobile application, according to some example embodiments.

To illustrate, FIG. 3 depicts a system that includes communications for play-while-away activity notifications using a mobile application, according to some example embodiments. In particular, FIG. 3 depicts a system 300 that illustrates the communications between a previous wagering game machine (where play-while-away activity is occurring) and a current wagering game machine regarding notification of play-while-away activity using a mobile application.

A previous wagering game machine 304 and a current wagering game machine 306 are part of a wagering game establishment 202 and communicatively coupled together. The previous wagering game machine 304 is a machine where a wagering game player was previously playing a wagering game. Also, the previous wagering game machine 304 provides for play-while-away activity wherein the wagering game player can continue to win even when they are not physically present at the wagering game machine. For example as described above, the previous wagering game machine 302 can be part of a bank of wagering game machines that includes a community event. The community event can provide wins to the wagering game player 316 even after they left the previous wagering game machine 304. The wagering game player 316 has a mobile device 318. A mobile application related to the play-while-away activity can be downloaded while the wagering game player 318 is still at the previous wagering game machine 304 or at the current wagering game machine 306. The downloading of the mobile application can be based on the communications described above in reference to FIGS. 1-2.

After starting the play-while-away activity at the previous wagering game machine 304, the wagering game player moves to the current wagering game machine 306 for play thereon (see player movement 350). During game play at the current wagering game machine 306, the previous wagering game machine 304 sends a notification of play-while-away activity (330) to the current wagering game machine 306. The previous wagering game machine 304 can route the notifications 330 to the current location of the wagering game player based on player account login at the wagering game machines. The current wagering game machine 306 then wirelessly transmits this notification to the mobile device 318 while the wagering game player 316 is wagering at the current wagering game machine 306.

The previous and current wagering game machines may or may not be the same type of wagering game machine. The notification can be text, images, video, etc. For example, the notification can be a video of the fish activity (showing the prizes won by the fish in the fish tank). In some example embodiments, the mobile application displays a live feed of the play-while-away activity on the wagering game player's mobile device 318 (based on a wireless communication with the current wagering game machine 306).

In some example embodiments, wagering at the current wagering game machine 306 positively affects the play-while-away activity. In particular, after the wagering game player's mobile device 318 establishes communication with the current wagering game machine 306 and the wagering game player 316 is wagering at the current wagering game machine 306, the previous wagering game machine 304 can be notified over the network (by either the current wagering game machine or the mobile device 318). In response, the chance of continued play, increased prizes, etc. occurs at the play-while-away wagering game. For example for the fish tank, the wagering game player's fish has a longer life expectancy in the fish tank after notification of wagering at the current wagering game machine 306.

In some example embodiments, if the wagering game player's mobile device 318 has established wireless communication with the current wagering game machine 306 and the player is actively wagering (e.g., credits on the machine, wagered in the last minute, etc.) and the player is still part of the play-while-away activity, the wagering game player 316 is placed into another play-while-away wagering game (e.g., a new fish in another fish tank). Alternatively or in addition, if the wagering game player's mobile device 318 has established wireless communication with the current wagering game machine and the wagering game player 316 is actively wagering and the wagering game player 316 is still part of the play-while-away activity, the wagering game player 316 receives an additional prize, receives a multiplier of the prizes won at the play-while-away wagering game, etc. Such a configuration encourages the wagering game player to continue to wager while away from the play-while-away wagering game.

Example Scavenger Hunt Mobile Application

Some example embodiments are applicable to a scavenger hunt-based activity across a number of wagering games. In such an example, a wagering game player is required to perform different types of wagering game activities at different wagering game machines to complete the scavenger hunt. The wagering game player's mobile device can include a mobile application to wirelessly communicate with these different wagering game machines. In particular, after an assigned wagering for a particular wagering game machine is complete, the mobile application on the mobile device receives a wireless communication from this wagering game machine of this completed task. Accordingly, the particular mobile application tracks the completion of the different tasks for the scavenger hunt by the wagering game player. After completion of the tasks, the wagering game player can then be given a prize (game credits, discounts to a restaurant, free points to the player accounts, etc.).

Figure 4:
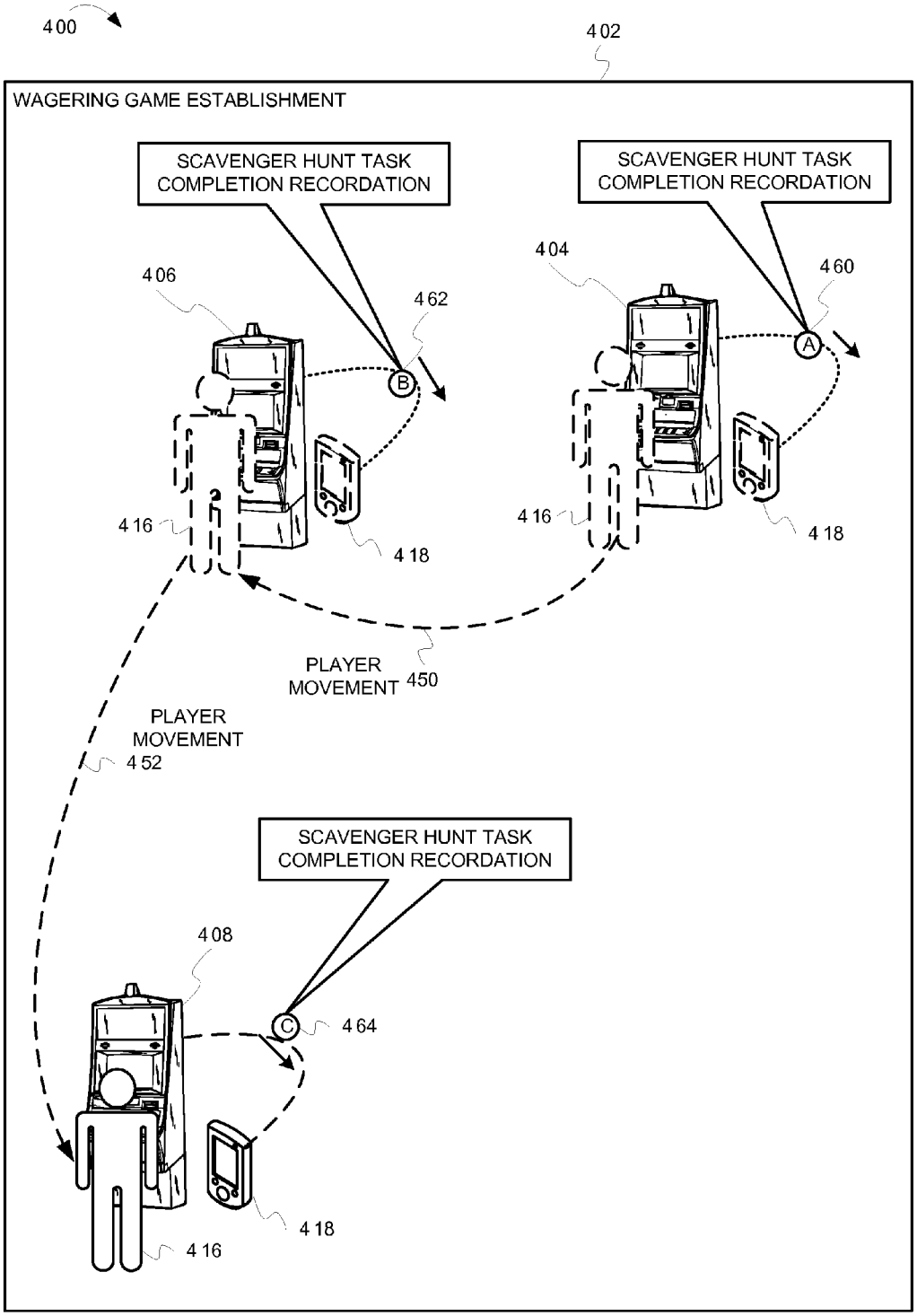
FIG. 4 depicts a system that includes communications for tracking scavenger hunt task completion in a wagering game environment using a mobile application, according to some example embodiments.

To illustrate, FIG. 4 depicts a system that includes communications for tracking scavenger hunt task completion in a wagering game environment using a mobile application, according to some example embodiments. In particular, FIG. 4 depicts a system 400 that illustrates three different wagering game machines where a wagering game player is required to perform some task thereon to complete a scavenger hunt. For example, the wagering game player is required to wager a minimum amount, win a particular jackpot, win at least a minimum amount, etc.

A wagering game machine 404, a wagering game machine 406, and a wagering game machine 408 are part of a wagering game establishment 402. Although not shown, the wagering game machines 404-408 can be coupled together over a network (see FIG. 1). In this example, a wagering game player 416 is required to perform a task at each of the wagering game machines to complete a scavenger hunt. Also, the recordation of completion of each task can be recorded on the wagering game player's mobile device (mobile device 418) using a wireless communication between a mobile application executing on the mobile device and each of the wagering game machines. The associated mobile application can be downloaded to the mobile device based on communications with one of the wagering game machines as described above in reference to FIG. 1.

In this example, the wagering game player 416 completes a first task for the scavenger hunt at the wagering game machine 404. Using the wireless communication, the mobile application on the mobile device 418 can request that the wagering game machine 404 transmit an indication of completion of the task back to the mobile application after the wagering game player 416 completes the task (e.g., reaching a given level in the wagering game, wager a minimum amount, win a particular jackpot, win at least a minimum amount, etc.). After completion of the first task, the wagering game machine 404 transmits a communication 460 to the mobile device 418 that provides for recordation of completion of the first task. The mobile application on the mobile device 418 can record this completion and also track the completion of all tasks for the scavenger hunt. The wagering game player 416 then moves to the wagering game machine 406 (see player movement 450).

The wagering game player 416 completes a second task for the scavenger hunt at the wagering game machine 406. Using the wireless communication, the mobile application on the mobile device 418 can request that the wagering game machine 406 transmit an indication of completion of the task back to the mobile application after the wagering game player 416 completes the task (e.g., reaching a given level in the wagering game, wager a minimum amount, win a particular jackpot, win at least a minimum amount, etc.). After completion of the second task, the wagering game machine 406 transmits a communication 462 to the mobile device 418 that provides for recordation of completion of the second task. The mobile application on the mobile device 418 can record this completion. The wagering game player 416 then moves to the wagering game machine 408 (see player movement 452).

The wagering game player 416 completes a third and final task for the scavenger hunt at the wagering game machine 408. Using the wireless communication, the mobile application on the mobile device 418 can request that the wagering game machine 408 transmit an indication of completion of the task back to the mobile application after the wagering game player 416 completes the task (e.g., reaching a given level in the wagering game, wager a minimum amount, win a particular jackpot, win at least a minimum amount, etc.). After completion of the third task, the wagering game machine 408 transmits a communication 464 to the mobile device 418 that provides for recordation of completion of the third task. The mobile application on the mobile device 418 can record this completion. The scavenger hunt is then complete. The mobile application on the mobile device 418 can communicate with a remote server, wagering game server, etc. to provide for the prize to the wagering game player 416. For example, a player account for the wagering game player 416 can be updated with game credits, player points, etc.

Example Mobile Device

Figure 5:
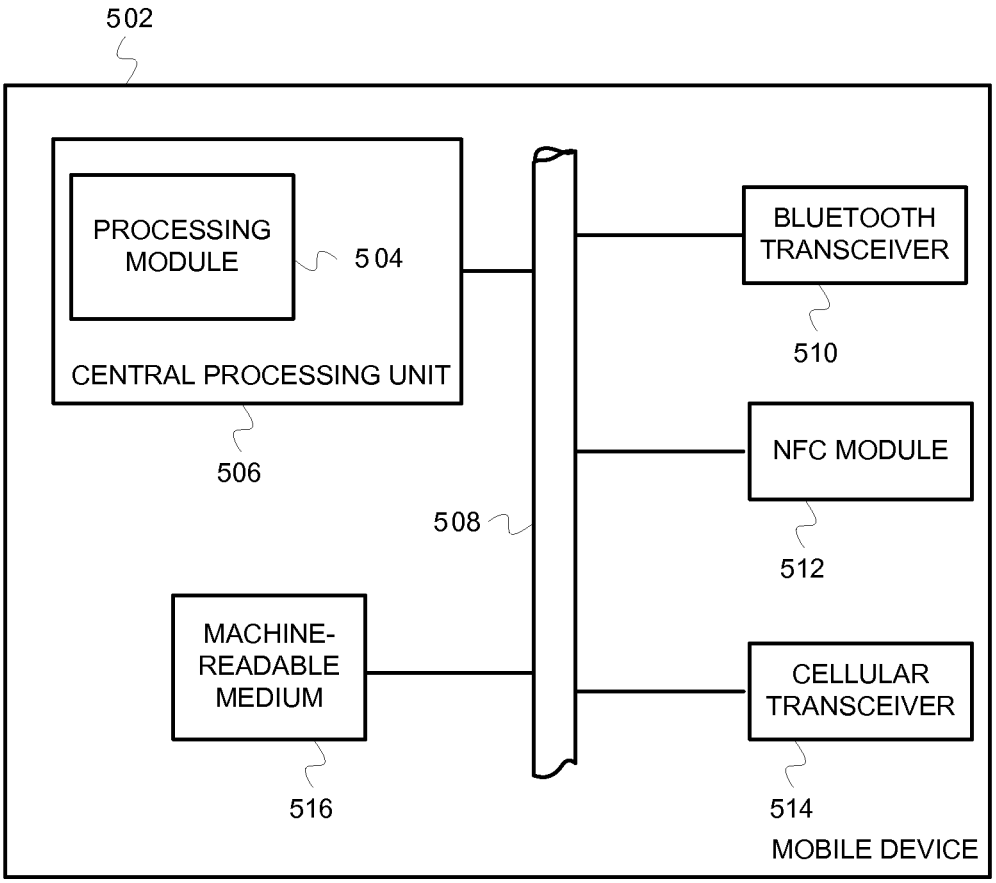
FIG. 5 depicts a more detailed block diagram of a mobile device, according to some example embodiments.

FIG. 5 depicts a more detailed block diagram of a mobile device, according to some example embodiments. In particular, FIG. 5 illustrates the relevant components for various types of wireless communications in a mobile device, according to some example embodiments. FIG. 5 depicts a mobile device 502 that includes a Bluetooth transceiver 510, an NFC module 512, a cellular transceiver 514, a central processing unit 506, and a machine-readable medium 516 that are communicatively coupled together through a communications bus 508. The central processing unit 506 also includes a processing module 504 executing therein. The processing module 504 can be software, firmware, hardware, or a combination thereof. The processing module 504 can process the different communications transmitted and received from and to the Bluetooth transceiver 510, the NFC module 512, and the cellular transceiver 514. The machine-readable medium 516 can be representative of either or both volatile and non-volatile machine readable media. The machine-readable medium 516 can store an owner identification for the player associated with the mobile device 502 to enable player login and authentication into a wagering game machine (as described above).

The NFC module 512 can provide NFC communications with the mobile device. For example, there can be NFC communications between the mobile device 502 and a wagering game machine, between the mobile device 502 and another mobile device, etc. The NFC module 512 can be used to provide NFC communications for various types of applications (as described herein).

The Bluetooth transceiver 510 can provide Bluetooth communications with the mobile device 502. For example, there can be Bluetooth communications between the mobile device 502 and a wagering game machine, between the mobile device 502 and another mobile device, etc. In some applications, the communications can be used to exchange data to configure the pairing of the mobile device 502 with another device (e.g., a wagering game machine) for Bluetooth communication. The data can include the parameters for the communication, password, secret key, etc. Subsequently, the Bluetooth communication can be used to provide communication between the mobile device and the other device. The Bluetooth communication can be based on Bluetooth v1.0, Bluetooth v1.0B, Bluetooth v1.1, Bluetooth v1.2, Bluetooth v2.0+Enhanced Data Rate (EDR), Bluetooth v2.1+EDR, Bluetooth v3.0+HS, Bluetooth v4.0, Bluetooth low energy, etc.

The cellular transceiver 514 can provide cellular communication with the mobile device 502. With reference to FIG. 1, the cellular transceiver 514 can be used to provide communications the different backend servers over the network 112. The cellular communication can be based on Global System for Mobile Communications (GSM), General Packet Radio Service (GPRS), Code Division Multiple Access (CDMA), Evolution-Data Optimized (EV-DO), Enhanced Data Rates for GSM Evolution (EDGE), 3GSM, Digital Enhanced Cordless Telecommunications (DECT), Digital AMPS (IS-136/TDMA), Integrated Digital Enhanced Network (iDEN), Long Term Evolution (LTE), Worldwide Interoperability for Microwave Access (WiMax), etc.

Example Operations

This section describes operations associated with some example embodiments. In the discussion below, the flowcharts will be described with reference to the block diagrams presented above. However, in some example embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some example embodiments, the operations can be performed in series, while in other embodiments, one or more of the operations can be performed in parallel. Moreover, some example embodiments can perform less than all the operations shown in any flowchart.

Figure 6:
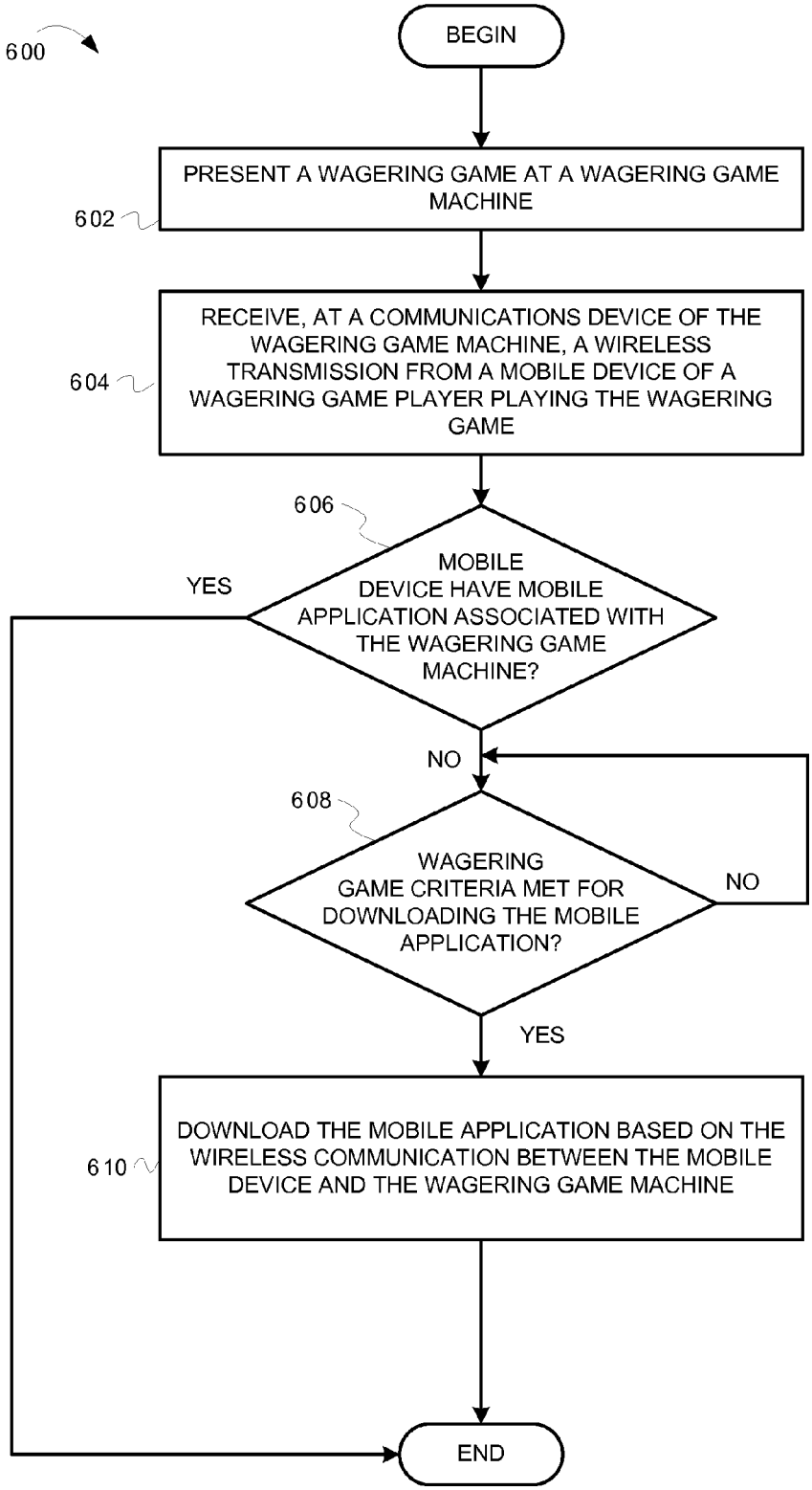
FIG. 6 depicts a flowchart for downloading a mobile application to a mobile device of a wagering game player based on wireless communications with a wagering game machine that the wagering game player is playing, according to some example embodiments.
Figure 7:
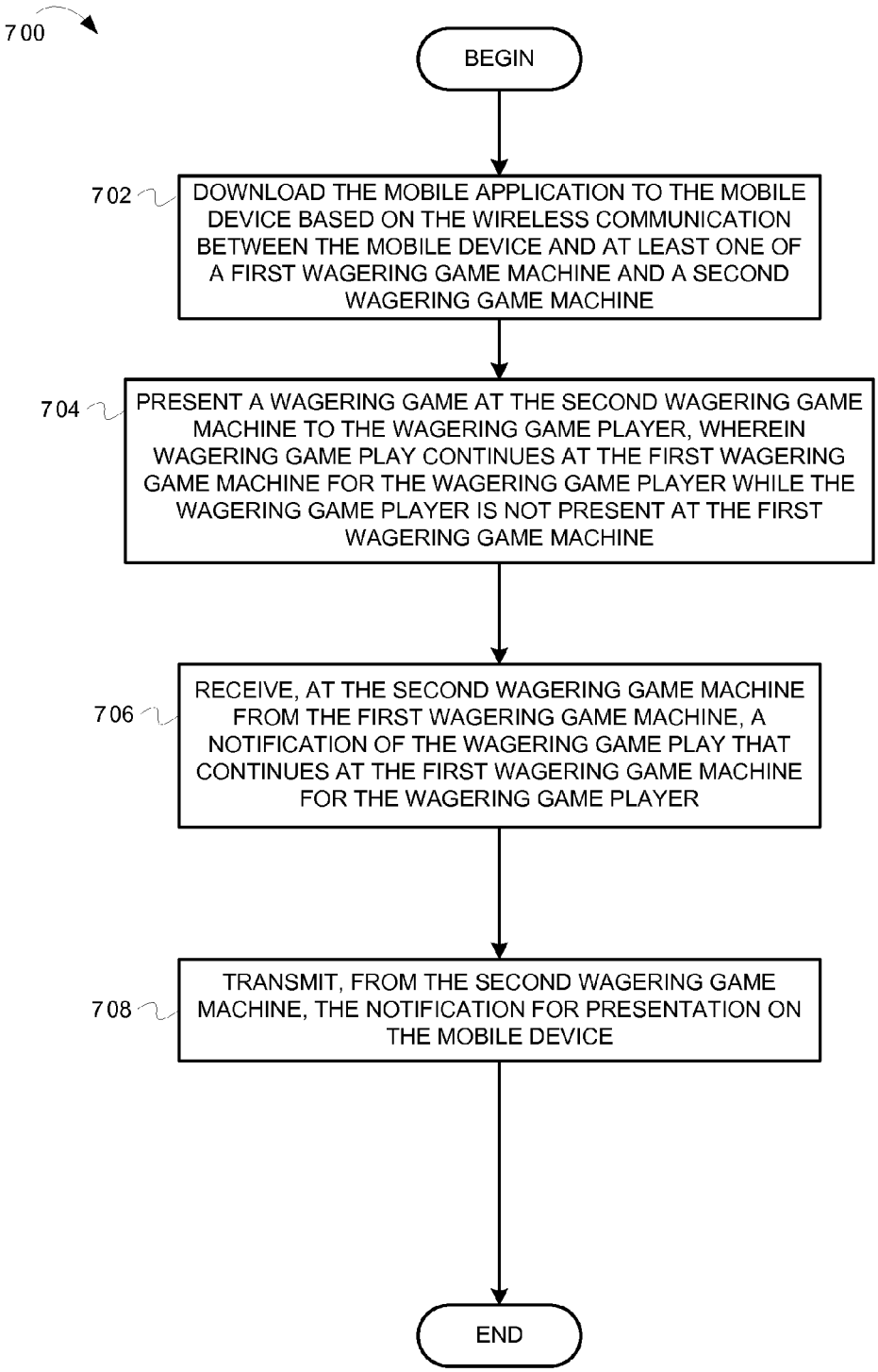
FIG. 7 depicts a flowchart for using a mobile application on a mobile device to provide notifications of play-while-away activity at a different wagering game machine, according to some example embodiments.

The section will discuss FIGS. 6-7. The discussion of FIG. 6 will describe example operations for downloading a mobile application to a mobile device in relation to a wagering game machine. The discussion of FIG. 7 will describe example operations for use of a mobile application in a mobile device for notification of play-while-away activity at a wagering game machine.

In particular, FIG. 6 depicts a flowchart for downloading a mobile application to a mobile device of a wagering game player based on wireless communications with a wagering game machine that the wagering game player is playing, according to some example embodiments. In this example, operations of a flowchart 600 are performed by different components of the wagering game machine and are described in reference to FIG. 1. An example architecture of a wagering game machine is described in more detail below in reference to FIG. 8. The operations of the flowchart 600 begin at block 602.

At block 602, a wagering game module presents a wagering game at a wagering game machine. With reference to FIG. 1, a wagering game module executing in the wagering game machine 114 presents a wagering game. The operations of the flowchart 600 continue at block 604.

At block 604, a communications device of the wagering game machine receives a wireless transmission from a mobile device of a wagering game player playing the wagering game. The communications device can be hardware, software, firmware or a combination thereof for providing for communications external to the wagering game machine. With reference to FIG. 1, the communications device of the wagering game machine 114 receives the NFC communication 120 from the mobile device 118. The operations of the flowchart 600 continue at block 606.

At block 606, the communications device determines whether the mobile device has a mobile application associated with the wagering game machine. The communications device can query the mobile device 118 to determine whether the mobile device 118 has the mobile application associated with the wagering game machine 114. If the mobile device does have the mobile application, operations of the flowchart 600 are complete. Otherwise, operations of the flowchart 600 continue at block 608.

At block 608, the communications devices determines whether wagering game criteria have been met for downloading the mobile application to the mobile device. The wagering game criteria can vary. Examples include a wagering game player logging into a player account associated with the wagering game establishment 102 and/or the wagering game manufacturer, exceeding a certain monetary amount inputted into the wagering game machine 114 (i.e., coin-in), exceeding a certain monetary amount wagered at the wagering game machine 114, etc. If the wagering game criteria have been met, operations of the flowchart 600 continue at block 610. Otherwise, operations remain at block 608 until the wagering game criteria are met.

At block 610, the communications device causes the mobile application to be downloaded to the mobile device based on the wireless communication between the mobile device and the wagering game machine. The mobile application can be downloaded from or through the wagering game machine 114 using the NFC communication 120. Alternatively or in addition, the mobile application can be downloaded independent of the wagering game machine 114 and through the wireless communication with the network 150. The mobile application can be stored in the wagering game machine manufacturer cloud services 104. Accordingly, the mobile application can be accessed through the wagering game machine 114 and the wagering game server 116. Alternatively or in addition, the mobile application can be accessed from the wagering game machine manufacturer cloud services 104 using any one of the servers 106-110. For example, the mobile device 118 can download the mobile application through an account on the social networking website using the social networking website server 106. In some example embodiments, the mobile application can be stored and accessed from the application store website server 110. In some example embodiments, the wagering game player 116 is given the option of the location from which to download and the route for the download. Operations of the flowchart 600 are complete.

FIG. 7 depicts a flowchart for using a mobile application on a mobile device to provide notifications of play-while-away activity at a different wagering game machine, according to some example embodiments. In this example, operations of a flowchart 700 are performed by different components of a wagering game machine and are described in reference to FIG. 3. An example architecture of a wagering game machine is described in more detail below in reference to FIG. 8. The operations of the flowchart 700 begin at block 702.

At block 702, a communications device of a first wagering game machine or a second wagering game machine causes the mobile application to be downloaded to the mobile device based on the wireless communication between the mobile device and the first wagering game machine or the second wagering game machine. With reference to FIG. 3, a mobile application related to the play-while-away activity can be downloaded while the wagering game player 318 is still at the previous wagering game machine 304 or at the current wagering game machine 306. The downloading of the mobile application can be based on the communications described above in reference to FIGS. 1-2. Operations of the flowchart 700 continue at block 704.

At block 704, a wagering game module at the second wagering game machine presents a wagering game at the second wagering game machine to the wagering game player, wherein wagering game play continues at the first wagering game machine for the wagering game player while the wagering game player is not present at the first wagering game machine. With reference to FIG. 3, a wagering game module executing in the current wagering game machine 306 presents a wagering game, wherein wagering game play continues at the previous wagering game machine 304 for the wagering game player 316 while the wagering game player 316 is not present at the previous wagering game machine 304. Operations of the flowchart 700 continue at block 706.

At block 706, the communications device of the second wagering game machine receives, from the first wagering game machine, a notification of the wagering game play that continues at the first wagering game machine for the wagering game player. With reference to FIG. 3, during game play at the current wagering game machine 306, the previous wagering game machine 304 sends a notification of play-while-away activity (330) to the current wagering game machine 306. The previous wagering game machine 304 can route the notifications 330 to the current location of the wagering game player based on player account login at the wagering game machines. Operations of the flowchart 700 continue at block 708.

At block 708, the communications device transmits, from the second wagering game machine, the notification of the wagering game play at the first wagering game machine for presentation on the mobile device using the mobile application. For example, this notification of the wagering game play at the first wagering game machine can be transmitted during a time when the wagering game player continues playing the wagering game at the second wagering game machine. With reference to FIG. 3, the current wagering game machine 306 wirelessly transmits this notification to the mobile device 318 while the wagering game player 316 is wagering at the current wagering game machine 306. Operations of the flowchart 700 are complete.

Operating Environment

This section describes an example operating environment and presents structural aspects of some embodiments. This section includes discussion about wagering game machine architectures and wagering game networks.

Wagering Game Machine Architecture

Figure 8:
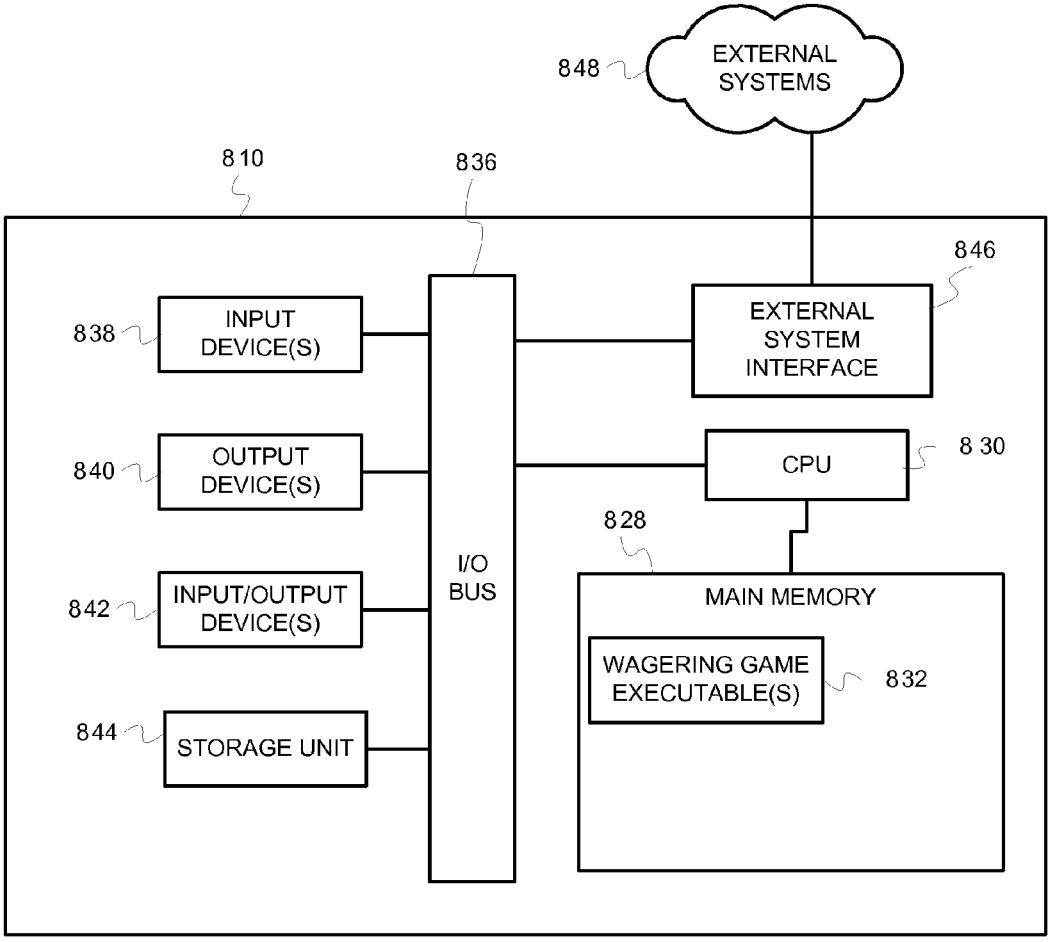
FIG. 8 depicts a block diagram illustrating a wagering game machine architecture, according to some example embodiments.

FIG. 8 depicts a block diagram illustrating a wagering game machine architecture, according to some example embodiments. In particular, FIG. 8 depicts an architecture of the wagering game machine 102 of FIG. 1. The gaming terminal 810 includes a central processing unit (CPU) 830 connected to a main memory 832. The CPU 830 may include any suitable processor(s), such as those made by Intel and AMD. By way of example, the CPU 830 includes a plurality of microprocessors including a master processor, a slave processor, and a secondary or parallel processor. CPU 830, as used herein, comprises any combination of hardware, software, or firmware disposed in or outside of the gaming terminal 810 that is configured to communicate with or control the transfer of data between the gaming terminal 810 and a bus, another computer, processor, device, service, or network. The CPU 830 comprises one or more controllers or processors and such one or more controllers or processors need not be disposed proximal to one another and may be located in different devices or in different locations. The CPU 830 is operable to execute all of the various gaming methods and other processes disclosed herein. The main memory 828 includes a wagering game executable 832. In some example embodiments, the wagering game executable 832 may present wagering games, such as video poker, video black jack, video slots, video lottery, etc., in whole or part. The wagering game module 832 can also process the wireless communications received and transmitted (as described above).

The CPU 830 is also connected to an input/output (I/O) bus 836, which can include any suitable bus technologies, such as an AGTL+ frontside bus and a PCI backside bus. The I/O bus 836 is connected to various input devices 838, output devices 840, and input/output devices 842. The I/O bus 836 is also connected to storage unit 844 and external system interface 846, which is connected to external system(s) 848 (e.g., wagering game networks).

The external system 848 includes, in various aspects, a gaming network, other gaming terminals, a gaming server, a remote controller, communications hardware, or a variety of other interfaced systems or components, in any combination. In yet other aspects, the external system 848 may comprise a player's portable electronic device (e.g., cellular phone, electronic wallet, etc.) and the external system interface 846 is configured to facilitate wireless communication and data transfer between the portable electronic device and the CPU 830, such as by a near-field communication path operating via magnetic-field induction or a frequency-hopping spread spectrum RF signals (e.g., Bluetooth, etc.).

The gaming terminal 810 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 848 ("thin client" gaming terminal), or are distributed therebetween in any suitable manner ("intermediate client" gaming terminal).

Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Wagering Game Networks

Figure 9:
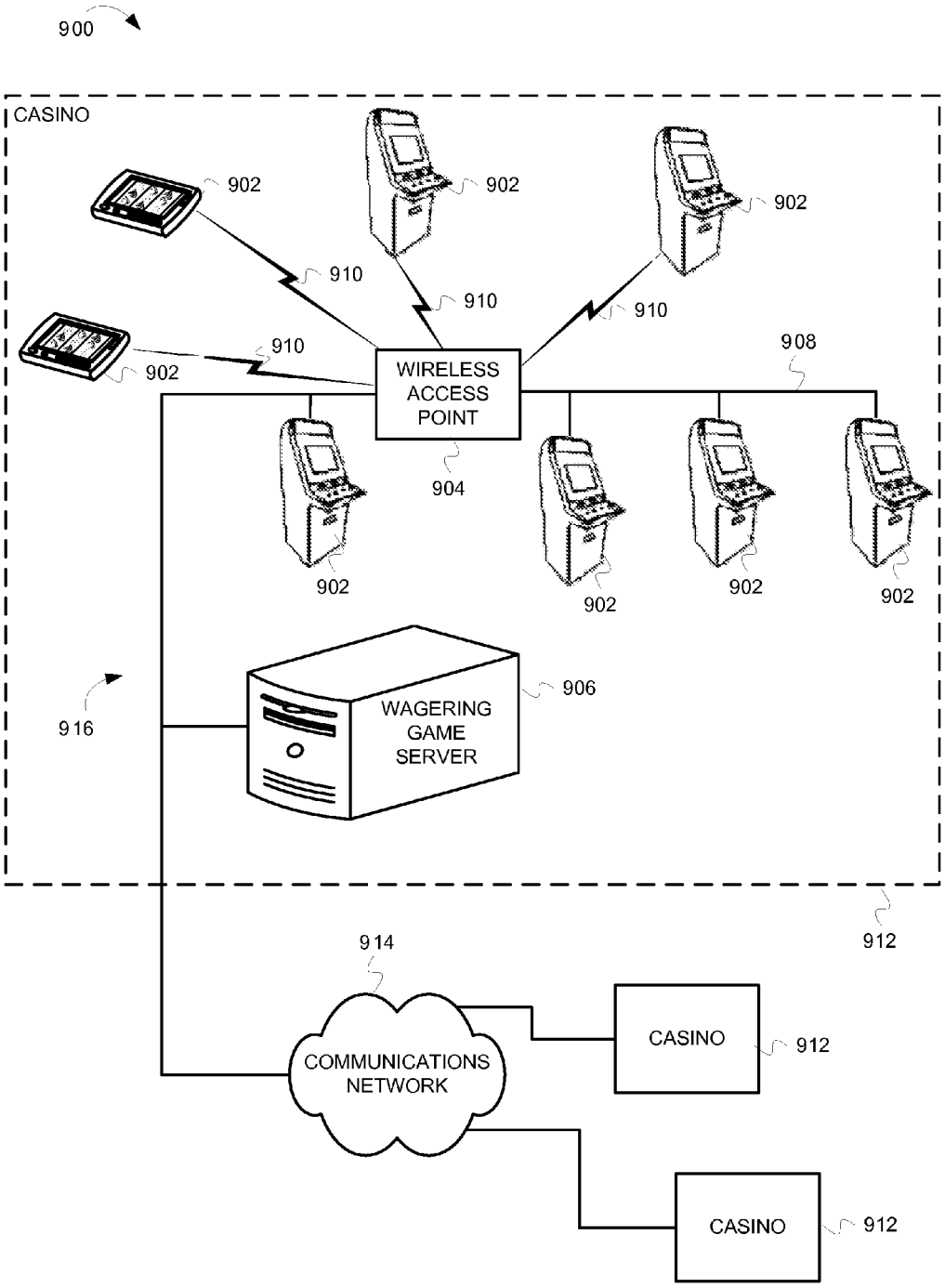
FIG. 9 depicts a block diagram illustrating a wagering game network, according to some example embodiments.

FIG. 9 is a block diagram illustrating a wagering game network 900, according to some example embodiments. As shown in FIG. 9, the wagering game network 900 includes a plurality of casinos 912 connected to a communications network 914.

Each casino 912 includes a local area network 916, which includes an access point 904, a wagering game server 906, and wagering game machines 902. The access point 9304 provides wireless communication links 910 and wired communication links 908. The wired and wireless communication links can employ any suitable connection technology, such as Bluetooth, 802.11, Ethernet, public switched telephone networks, SONET, etc. In some embodiments, the wagering game server 906 can serve wagering games and distribute content to devices located in other casinos 912 or at other locations on the communications network 914. In some example embodiments, the wagering game server 906 is representative of one of more of the backend servers illustrated in FIG. 1.

The wagering game machines 902 described herein can take any suitable form, such as floor standing models, handheld mobile units, bartop models, workstation-type console models, etc. Further, the wagering game machines 902 can be primarily dedicated for use in conducting wagering games, or can include non-dedicated devices, such as mobile phones, personal digital assistants, personal computers, etc. In one embodiment, the wagering game network 900 can include other network devices, such as accounting servers, wide area progressive servers, player tracking servers, and/or other devices suitable for use in connection with embodiments of the invention.

In some embodiments, wagering game machines 902 and wagering game servers 906 work together such that a wagering game machine 902 can be operated as a thin, thick, or intermediate client. For example, one or more elements of game play may be controlled by the wagering game machine 902 (client) or the wagering game server 906 (server). Game play elements can include executable game code, lookup tables, configuration files, game outcome, audio or visual representations of the game, game assets or the like. In a thin-client example, the wagering game server 906 can perform functions such as determining game outcome or managing assets, while the wagering game machine 902 can present a graphical representation of such outcome or asset modification to the user (e.g., player). In a thick-client example, the wagering game machines 902 can determine game outcomes and communicate the outcomes to the wagering game server 906 for recording or managing a player's account.

In some embodiments, either the wagering game machines 902 (client) or the wagering game server 906 can provide functionality that is not directly related to game play. For example, account transactions and account rules may be managed centrally (e.g., by the wagering game server 906) or locally (e.g., by the wagering game machine 902). Other functionality not directly related to game play may include power management, presentation of advertising, software or firmware updates, system quality or security checks, etc.

Any of the wagering game network components (e.g., the wagering game machines 902) can include hardware and machine-readable media including instructions for performing the operations described herein.

Example Wagering Game Machine

Figure 10:
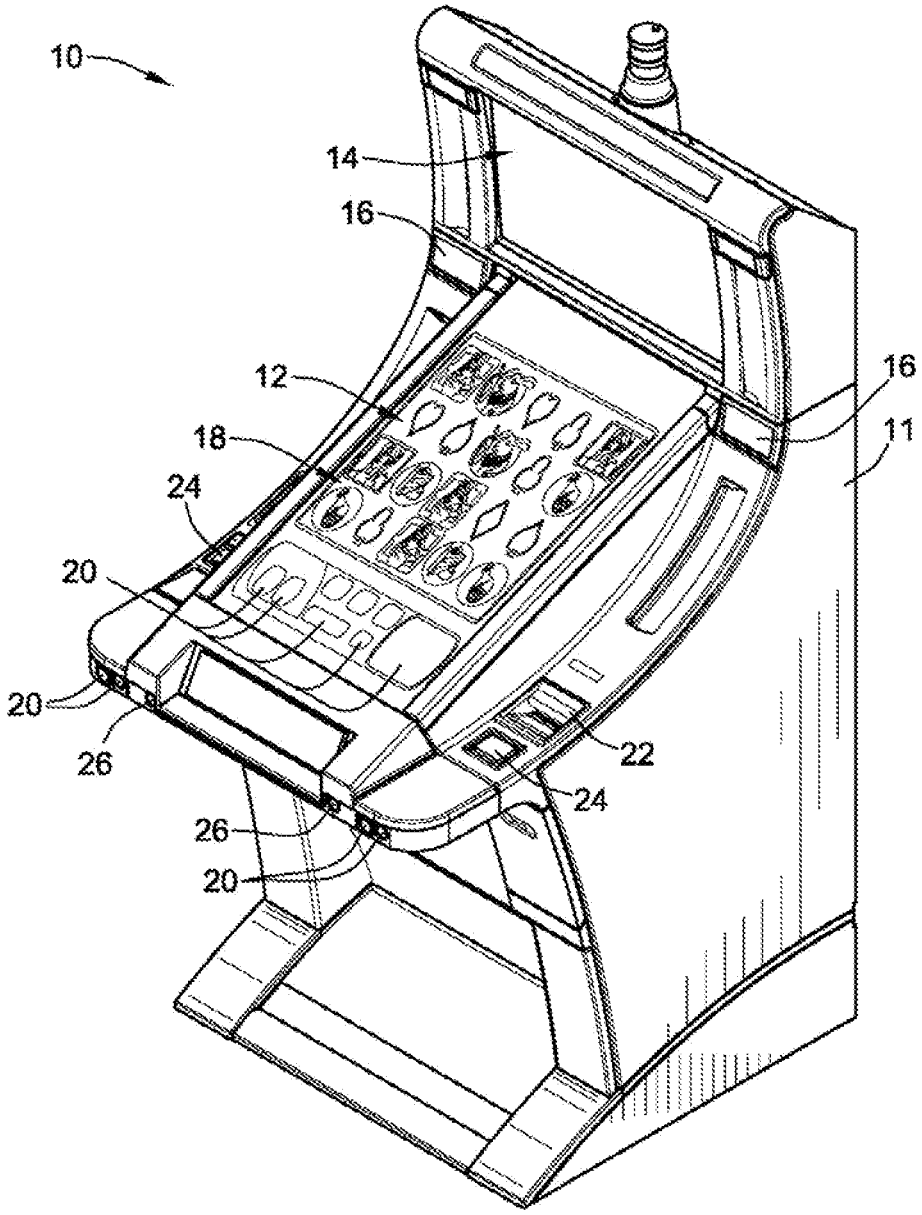
FIG. 10 depicts a perspective view of a wagering game machine, according to some example embodiments.

FIG. 10 depicts a perspective view of a wagering game machine, according to some example embodiments. Referring to FIG. 10, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433 and Patent Application Publication Nos. US2010/0062196 and US2010/0234099, which are incorporated herein by reference in their entireties.

The gaming terminal 10 illustrated in FIG. 10 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 11:
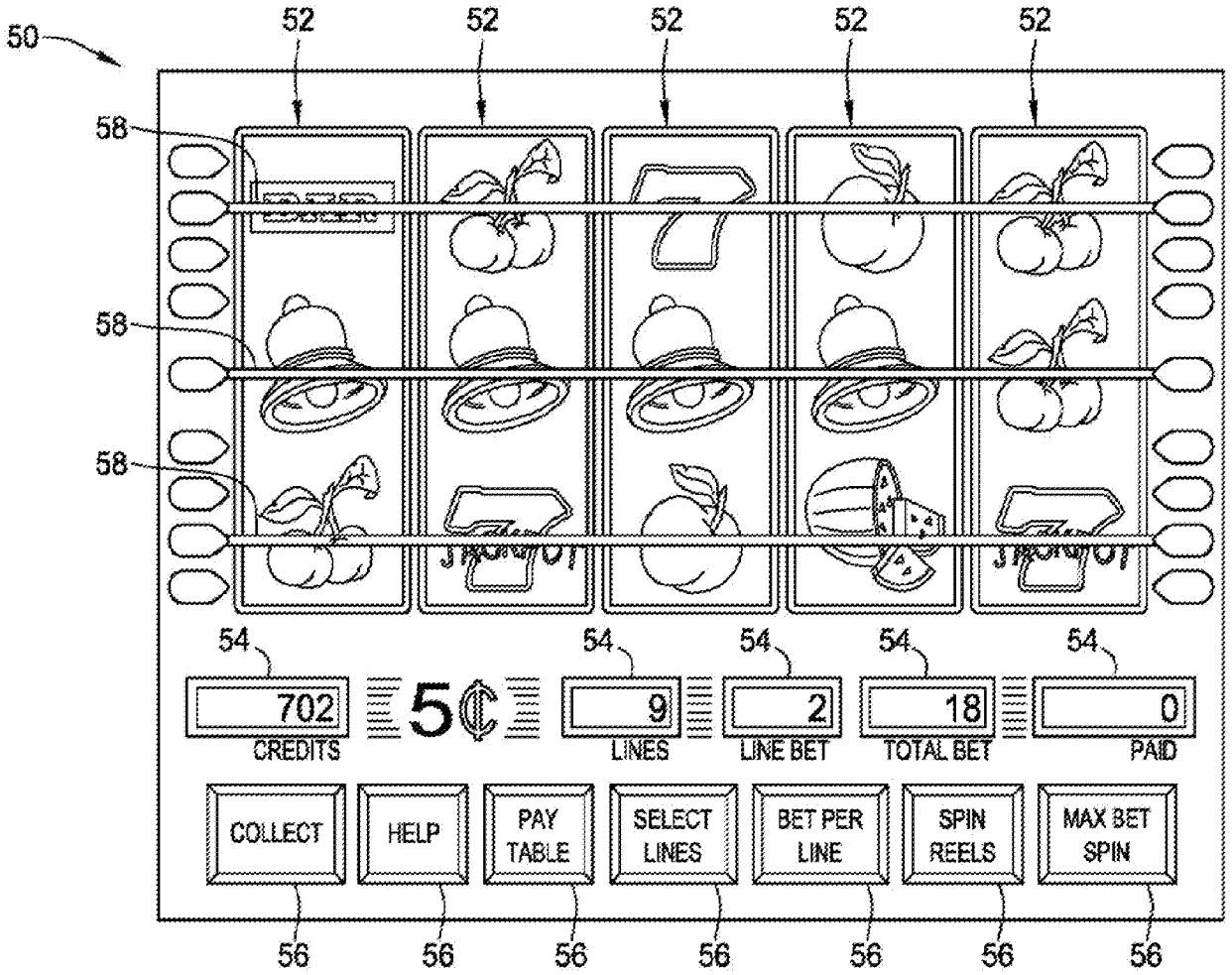
FIG. 11 depicts an image of a base-game screen for a wagering game machine, according to some example embodiments.

FIG. 11 depicts an image of a base-game screen for a wagering game machine, according to some example embodiments. Referring to FIG. 11, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 15. The CPU operate(s) to execute a wagering game program causing the primary display area 12 or the secondary display area 14 to display the wagering game.

In response to receiving a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media, the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A method comprising:

presenting at least one wagering game at a wagering game machine primarily dedicated to playing the at least one wagering game, the wagering game machine including an electronic display device and one or more electronic input devices;

establishing, using a wireless communications device of the wagering game machine, a wireless communication between the wagering game machine and a mobile device, after the mobile device is within a wireless communication range of the wagering game machine;

detecting, via at least one of the one or more electronic input devices, a physical item associated with a monetary value that establishes a credit balance;

initiating the at least one wagering game in response to an input indicative of a wager covered by the credit balance;

in response to a wagering game criteria being satisfied after initiation of the at least one wagering game and after establishing the wireless communication, authorizing access to content on the mobile device based on a context of the at least one wagering game at the wagering game machine, wherein the content is accessible on the mobile device while the at least one wagering game is currently being played at the wagering game machine; and receiving, via at least one of the one or more electronic input devices, a cashout input that initiates a payout from the credit balance.

2. The method of claim 1, wherein the authorizing access to the content comprises downloading a mobile application to the mobile device for execution on the mobile device, wherein the mobile application comprises an application that is executable on the mobile device.

3. The method of claim 2, wherein the downloading of the mobile application comprises downloading the mobile application from the wagering game machine to the mobile device via the wireless communication.

4. The method of claim 2, wherein the downloading of the mobile application to the mobile device comprises transmitting an instruction from the wagering game machine to the mobile device via the wireless communication to cause the mobile device to download the mobile application from a remote server.

5. The method of claim 2, wherein the mobile application comprises a mobile version of the at least one wagering game, wherein the mobile version comprises a version of the at least one wagering game that is executable on the mobile device.

6. The method of claim 5, wherein the mobile version of the at least one wagering game comprises a full version of the at least one wagering game, wherein the wagering game criteria comprises obtaining an achievement in the at least one wagering game on the wagering game machine.

7. The method of claim 5, wherein a limited version of the mobile version of the at least one wagering game is available for download to the mobile device without the establishing of the wireless communication with the wagering game machine.

8. The method of claim 2, wherein the mobile application comprises an application configured to record entries for wagering game activity at the wagering game machine, wherein the entries comprise an amount won or lost as a result of the wagering game activity, a date of the wagering game activity, and a serial number of the wagering game machine.

9. The method of claim 2, wherein the mobile application is configured to provide notification of availability of a different wagering game machine, wherein the method further comprises:

receiving, from the mobile application, an identification of the different wagering game machine;

receiving at the wagering game machine notification that the different wagering game machine is available; and providing, from the wagering game machine via the wireless communication, the notification to the mobile application.

10. The method of claim 1, further comprising:

in response to the establishing of the wireless communication, providing access to additional content of the at least one wagering game at the wagering game machine.

11. The method of claim 1, further comprising:

uploading content from the mobile device to the wagering game machine through the wireless communication wherein the content affects at least one of a visual element and an audio element of the at least one wagering game on the wagering game machine.

12. The method of claim 1, wherein the context comprises at least one of a type of the at least one wagering game, a current progress of play of the at least one wagering game, and a game play history of a wagering game player playing the at least one wagering game for the type of the at least one wagering game.

13. A wagering game machine primarily dedicated to playing a wagering game, the wagering game machine comprising:

at least one display device;

at least one processor;

one or more electronic input devices coupled to the at least one processor; and at least one memory device configured to store instructions that, when executed by the at least one processor, cause the wagering game machine to:

detect, via at least one of the one or more electronic input devices, a physical item associated with a monetary value that establishes a credit balance;

initiate the wagering game in response to an input indicative of a wager covered by the credit balance;

present the wagering game on the at least one display device;

present an outcome of the wagering game on the at least one display device, wherein the outcome is based on one or more random elements generated by a random number generator;

establish a wireless communication between the wagering game machine and a mobile device;

in response to a wagering game criteria being satisfied during play of the wagering game and after establishment of the wireless communication, authorize access to content on the mobile device based on a context of the wagering game, wherein the content is accessible on the mobile device while the at least one wagering game is currently being played at the wagering game machine; and receive, via at least one of the one or more electronic input devices, a cashout input that initiates a payout from the credit balance.

14. The wagering game machine of claim 13, wherein the instructions to authorizing access to the content comprise instructions to download a mobile application to the mobile device, wherein the mobile application comprises an application that is executable on the mobile device.

15. The wagering game machine of claim 14, wherein the mobile application comprises a mobile version of the wagering game, wherein the mobile version comprises a version of the wagering game that is executable on the mobile device.

16. The wagering game machine of claim 15, wherein, as more achievements are obtained in the wagering game, additional content of the mobile version is provided for play at the mobile device.

17. The wagering game machine of claim 16, wherein a limited version of the mobile version of the wagering game is available for download to the mobile device without the establishment of the wireless communication with the wagering game machine.

18. The wagering game machine of claim 13, wherein the content on the mobile device updates for play-while-away activity for a community game that is separate from the wagering game at the wagering game machine.

19. The wagering game machine of claim 13, wherein the instructions that, when executed by the at least one processor, cause the wagering game machine to:

in response to the establishment of the wireless communication, provide access to additional content of the wagering game at the wagering game machine.

20. The wagering game machine of claim 13, wherein the instructions that, when executed by the at least one processor, cause the wagering game machine to:

upload content from the mobile device to the wagering game machine through the wireless communication wherein the content affects at least one of a visual element and an audio element of the at least one wagering game on the wagering game machine.

21. The wagering game machine of claim 13, wherein the context comprises at least one of a type of the at least one wagering game, a current progress of play of the at least one wagering game, and a game play history of a wagering game player playing the at least one wagering game for the type of the at least one wagering game.

22. One or more non-transitory machine-readable storage media including instructions which, when executed by one or more processors, cause the one or more processors to perform operations comprising:

detecting, via at least one of one or more electronic input devices of a wagering game machine primarily dedicated to playing at least one wagering game, a physical item associated with a monetary value that establishes a credit balance;

in response to an input indicative of a wager covered by the credit balance, presenting the at least one wagering game at the wagering game machine, wherein an outcome of the wagering game is based on one or more random elements generated by a random number generator;

establishing a wireless communication between the wagering game machine and a mobile device; and in response to a wagering game criteria being satisfied during play of the at least one wagering game and after establishing the wireless communication, authorizing access to content on the mobile device based on a context of the at least one wagering game at the wagering game machine, wherein the content is accessible on the mobile device while the at least one wagering game is currently being played at the wagering game machine; and receiving, via at least one of the one or more electronic input devices, a cashout input that initiates a payout from the credit balance.

23. The one or more non-transitory machine-readable storage media of claim 22, wherein the operations for authorizing access to the content comprises operations for downloading a mobile application to the mobile device for execution on the mobile device, wherein the mobile application comprises an application that is executable on the mobile device.

24. The one or more non-transitory machine-readable storage media of claim 23, wherein the mobile application comprises a mobile version of the at least one wagering game, wherein the mobile version comprises a version of the at least one wagering game that is executable on the mobile device.

25. The one or more non-transitory machine-readable storage media of claim 23, wherein the mobile application is configured to provide notification of availability of a different wagering game machine, wherein the operations comprise:

receiving, from the mobile application, identification of the different wagering game machine;

receiving at the wagering game machine notification that the different wagering game machine is available; and providing, from the wagering game machine via the wireless communication, the notification to the mobile application.

26. The one or more non-transitory machine-readable storage media of claim 22, wherein the instructions which, when executed by the one or more processors, cause the one or more processors to perform the operations further comprising:

in response to the establishing of the wireless communication, providing access to additional content of the at least one wagering game at the wagering game machine.

27. The one or more non-transitory machine-readable storage media of claim 22, wherein the instructions which, when executed by the one or more processors, cause the one or more processors to perform the operations further comprising:

uploading content from the mobile device to the wagering game machine through the wireless communication wherein the content affects at least one of a visual element and an audio element of the at least one wagering game on the wagering game machine.

28. The one or more non-transitory machine-readable storage media of claim 22, wherein the context comprises at least one of a type of the at least one wagering game, a current progress of play of the at least one wagering game, and a game play history of a wagering game player playing the at least one wagering game for the type of the at least one wagering game.

* * * * *